US011529596B2

(12) United States Patent
Tamminga et al.

(10) Patent No.: US 11,529,596 B2
(45) Date of Patent: Dec. 20, 2022

(54) HORIZONTAL MIXER WITH STACKED AUGERS

(71) Applicant: Jay-Lor International Inc., East Garafraxa (CA)

(72) Inventors: Jakob R. Tamminga, East Garafraxa (CA); Daniel Powers, Holdrege, NE (US)

(73) Assignee: Jay-Lor International Inc., East Garafraxa (CA)

( * ) Notice: Subject to any disclaimer, the term of this patent is extended or adjusted under 35 U.S.C. 154(b) by 23 days.

(21) Appl. No.: 16/287,557

(22) Filed: Feb. 27, 2019

(65) Prior Publication Data

US 2019/0270057 A1 Sep. 5, 2019
US 2020/0108362 A2 Apr. 9, 2020

Related U.S. Application Data

(60) Provisional application No. 62/637,105, filed on Mar. 1, 2018.

(51) Int. Cl.
*B22C 5/00* (2006.01)
*B01F 27/721* (2022.01)
(Continued)

(52) U.S. Cl.
CPC ..... *B01F 27/721* (2022.01); *B01F 27/0531* (2022.01); *B01F 27/1145* (2022.01);
(Continued)

(58) Field of Classification Search
CPC ... B01F 7/081; B01F 7/00041; B01F 7/00433
See application file for complete search history.

(56) References Cited

U.S. PATENT DOCUMENTS 3,482,821 A * 12/1969 Blackwood ..... B01F 13/0035 366/186
4,597,672 A * 7/1986 Neier ..... A01K 5/002 366/186
(Continued)

FOREIGN PATENT DOCUMENTS

GB 2159689 A * 12/1985 ..... A01D 43/00
JP 11103627 A * 4/1999
(Continued)

OTHER PUBLICATIONS

Google machine translation for "JP-11103627-A" (Year: 1999).*

*Primary Examiner* — Anshu Bhatia
*Assistant Examiner* — Gregory Y Huan
(74) *Attorney, Agent, or Firm* — Polsinelli PC

(57) ABSTRACT

A horizontal mixer for mixing bulk material, such as agricultural material, is provided. The horizontal mixer includes a mixing container for accommodating bulk agricultural material to be mixed. The mixing container includes side walls connected at their bottom edges by a trough; a front wall spanning a front side of the container; a rear wall spanning a rear side of the container; and an exit door through which mixed agricultural material can exit. Further, one or more bottom augers situated longitudinally in the trough, wherein at least one of the one or more bottom augers is a ribbon auger; and one or more top augers situated longitudinally in the mixing container stacked above the one or more bottom ribbon augers. The trough has a shape to accommodate the one or more bottom ribbon augers.

20 Claims, 7 Drawing Sheets

(51) Int. Cl.

| | |
|---|---|
| ***B01F 27/053*** | (2022.01) |
| ***B01F 27/1145*** | (2022.01) |
| *B01F 101/18* | (2022.01) |
| *B01F 101/33* | (2022.01) |

(52) U.S. Cl.
CPC ..... *B01F 2101/18* (2022.01); *B01F 2101/33* (2022.01); *B01F 2215/0481* (2013.01)

(56) References Cited

U.S. PATENT DOCUMENTS

| | | | | | |
|---|---|---|---|---|---|
| 5,228,775 | A * | 7/1993 | Horn | B01F 7/08 | 366/278 |
| 5,354,127 | A * | 10/1994 | Del Zotto | B01F 7/087 | 366/186 |
| 6,602,130 | B1 * | 8/2003 | Manning | B07B 13/16 | 460/100 |
| 8,697,185 | B2 * | 4/2014 | Mizwicki | B01J 2/10 | 427/212 |
| 2004/0136261 | A1 * | 7/2004 | Huber | B01F 7/083 | 366/152.1 |
| 2007/0280045 | A1 * | 12/2007 | Reinecke | B01F 7/00433 | 366/312 |

FOREIGN PATENT DOCUMENTS

| | | | | |
|---|---|---|---|---|
| WO | WO-9615889 | A1 * | 5/1996 | B01F 7/00391 |
| WO | WO-9919214 | A1 * | 4/1999 | B01F 7/081 |
| WO | WO-2007137346 | A1 * | 12/2007 | B28C 5/2054 |

* cited by examiner

HORIZONTAL MIXER WITH STACKED AUGERS

CROSS-REFERENCE

This application claims priority to U.S. provisional patent application 62/637,105 filed Mar. 1, 2018 which is incorporated herein by reference in its entirety.

FIELD OF THE INVENTION

The invention relates to agricultural machinery and more specifically to horizontal mixers for mixing bulk material including agricultural material such as feed, compost, animal bedding, etc.

BACKGROUND

Horizontal mixers are typically used to mix bulk material such as agricultural material including feed and bedding. Conventional mixers typically include one or more augers positioned horizontally and operate at about 5-12 rpm to mix the bulk material.

Generally, a significant amount of horsepower is required to rotate the augers as the load to be mixed can be very large and can range for example from 2,000 to 40,000 pounds. Further, the amount of time required to sufficiently mix the material can be significant and can be frustrating for the user as it can take up to 8-10 minutes to sufficiently mix a load.

A need therefore exists for a horizontal mixer that decreases either mixing times, power requirements or both while maintaining or possibly improving mix quality or overcoming other downfalls associated with conventional mixers as appreciated in the industry.

SUMMARY OF THE INVENTION

A horizontal mixer for mixing bulk material, such as agricultural material, that may be more quickly mixed and/or may be mixed using less power consumption than conventional horizontal mixers is provided. Further, even though the bulk material may be mixed more quickly and/or using less power, the quality of the mix may be maintained and may be improved as compared to conventional mixers. A horizontal mixer that implements a stacked auger setup that utilizes one or more bottom augers, at least one of which is a ribbon auger, and one or more top augers positioned above the one or more bottom ribbon augers is provided.

In one embodiment, the present invention provides for a horizontal mixer for mixing bulk material, the horizontal mixer comprising:

a mixing container for accommodating bulk material to be mixed, the mixing container comprising:

side walls connected at their bottom edges by a trough;

a front wall spanning a front side of the container;

a rear wall spanning a rear side of the container; and an exit door through which mixed material can exit;

one or more bottom augers situated longitudinally in the trough, wherein at least one of the one or more bottom augers is a ribbon auger; and one or more top augers situated longitudinally in the mixing container substantially above the one or more bottom ribbon augers, wherein the trough has a shape to accommodate the one or more bottom ribbon augers.

In a further embodiment of the horizontal mixer or mixers outlined above, a pitch on the one or more bottom ribbon augers is adapted to draw material inwards from the front and rear wall towards a middle area of the container.

In a further embodiment of the horizontal mixer or mixers outlined above, a pitch on the one or more top augers is adapted to draw material outwards from a middle area of the container towards the front and/or rear walls.

In a further embodiment of the horizontal mixer or mixers outlined above, the one or more top augers is a ribbon auger.

In a further embodiment of the horizontal mixer or mixers outlined above, there are at least two bottom augers and the second bottom auger is a conventional auger.

In a further embodiment of the horizontal mixer or mixers outlined above, there are at least two bottom augers and all bottom augers are a ribbon augers.

In a further embodiment of the horizontal mixer or mixers outlined above, there are two bottom augers and the trough has a W-shape including two adjacent longitudinal troughs, each for accommodating one of the bottom augers.

In a further embodiment of the horizontal mixer or mixers outlined above, there is a single bottom auger and the trough has a U-shape for accommodating the single bottom auger.

In a further embodiment of the horizontal mixer or mixers outlined above, the mixer comprises two bottom augers and a single top auger situated generally centered above the two bottom augers.

In a further embodiment of the horizontal mixer or mixers outlined above, the mixer comprises two bottom augers and two top augers situated generally above the two bottom augers and generally proximate the side walls of the mixer.

In a further embodiment of the horizontal mixer or mixers outlined above, the two top augers are situated generally above and at least slightly outward the two bottom augers.

In a further embodiment of the horizontal mixer or mixers outlined above, the mixer comprises a single bottom ribbon auger and a single top auger positioned above the bottom ribbon auger.

In a further embodiment of the horizontal mixer or mixers outlined above, the mixer comprises a single bottom ribbon auger and two top augers positioned above the bottom ribbon auger and generally proximate the side walls of the mixer.

In a further embodiment of the horizontal mixer or mixers outlined above, the one or more top augers have a different pitch and/or diameter than at least one of the one or more bottom augers.

In a further embodiment of the horizontal mixer or mixers outlined above, the one or more bottom augers have the same or a different pitch and/or diameter.

In a further embodiment of the horizontal mixer or mixers outlined above, the one or more top augers have the same or a different pitch and/or diameter.

In a further embodiment of the horizontal mixer or mixers outlined above, the top and bottom augers are adapted to be operated at a speed of 1 to 40 rpm.

In a further embodiment of the horizontal mixer or mixers outlined above, the top and bottom augers are adapted to be operated at a speed above 12 rpm.

In a further embodiment of the horizontal mixer or mixers outlined above, at least a portion of a front face of at least one of the ribbon augers is lined with stainless steel or a polymer.

In a further embodiment of the horizontal mixer or mixers outlined above, the lining has a varied thickness and comprises an increased thickness in a higher wear region.

In a further embodiment of the horizontal mixer or mixers outlined above, the bulk material to be mixed is bulk agricultural material.

DETAILED DESCRIPTION

Figure 1:
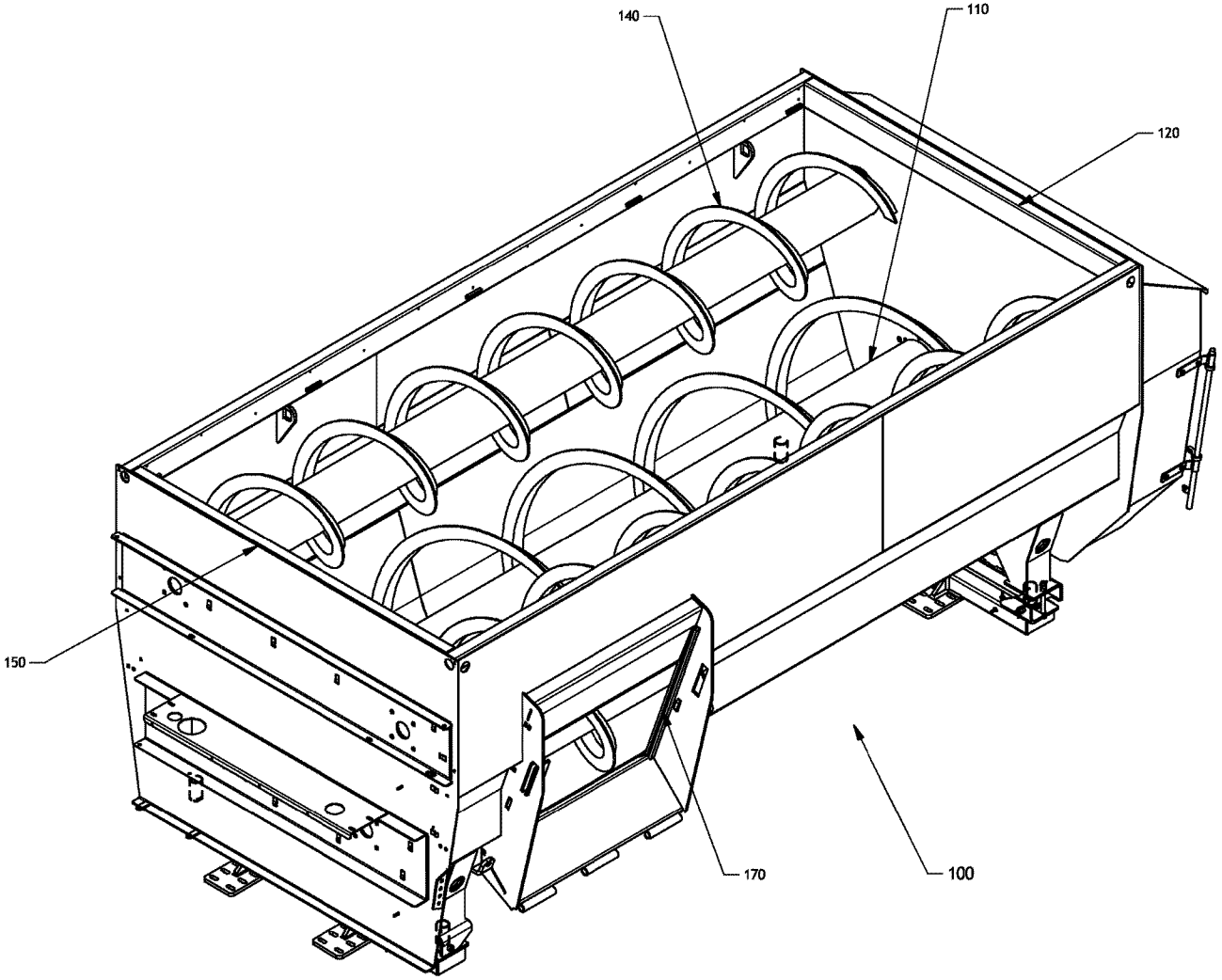
FIG. 1 is a schematic showing an isometric view of one embodiment of a four auger horizontal mixer with stacked top augers above two bottom augers.
Figure 2:
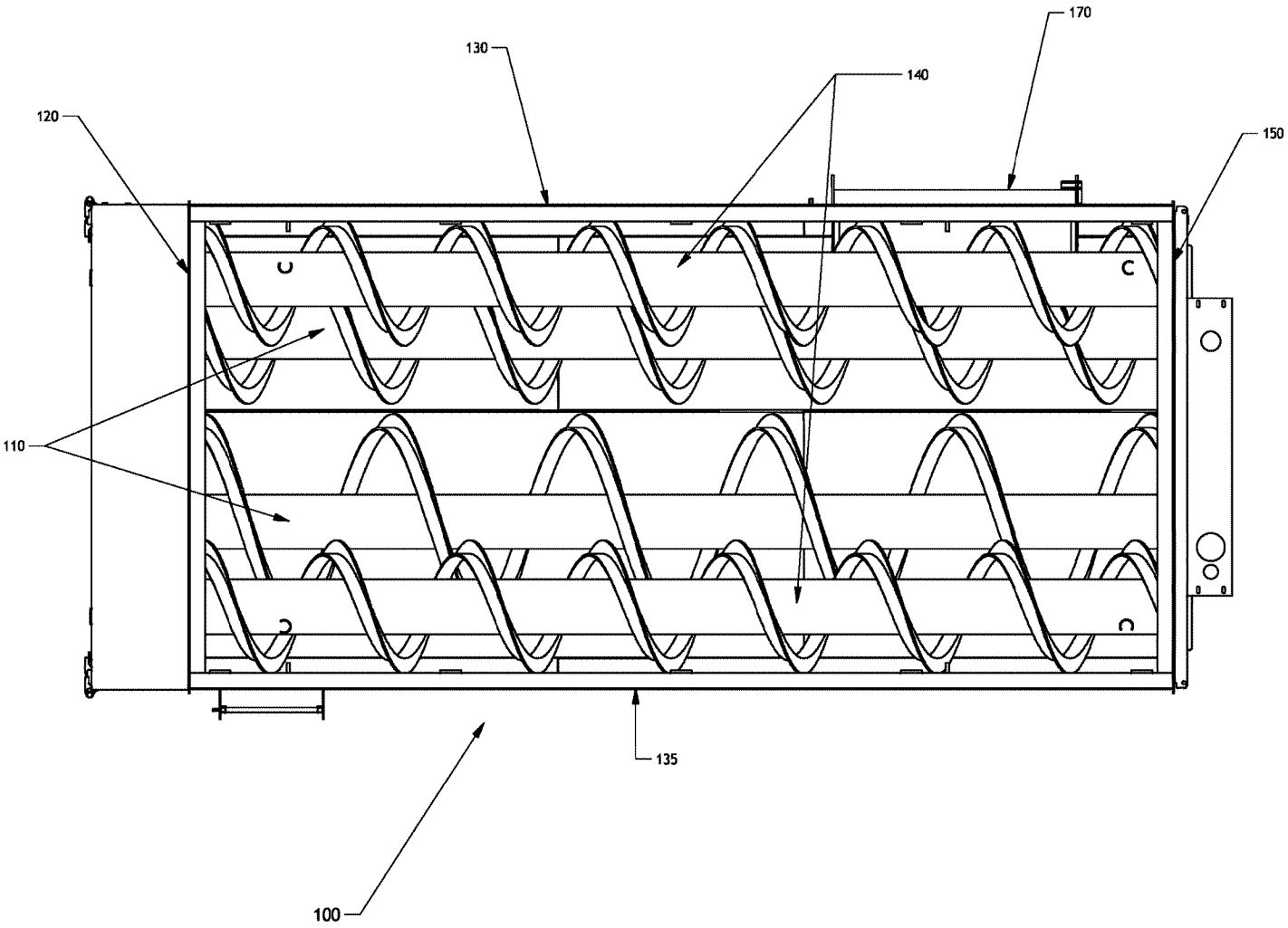
FIG. 2 is a schematic showing a top view of the horizontal mixer shown in FIG. 1.

Described herein are examples and embodiments of horizontal mixers including apparatuses, systems therefor and methods and processes of using same, for mixing bulk material such as agricultural material for example feed, compost or bedding. It will be appreciated that embodiments and examples are provided herein for illustrative purposes intended for those skilled in the art, and are not meant to be limiting in any way. All references to embodiments or examples throughout this disclosure should be considered as references to illustrative and non-limiting embodiments and illustrative and non-limiting examples. It will be appreciated that none of the features disclosed herein are intended to be essential unless specifically stipulated as such. Reference to any dimensions or measurements is not intended to be limiting and is not intended to be an exact and limiting measurement and the term "about" is intended to be applied to all such dimensions and measurements and at least accounts for inaccuracies and error associated with taking such measurements and the devices for taking such measurements.

A horizontal mixer for mixing bulk material, such as agricultural material, that may be more quickly mixed and/or may be mixed using less power consumption than conventional horizontal mixers is disclosed herein. Further, even though the bulk agricultural material may be mixed more quickly and/or using less power, the quality of the mix is maintained and may be improved as compared to conventional mixers.

To mix the bulk agricultural material more quickly and/or with a lower power consumption horizontal mixers of the present invention implement a stacked auger setup that utilizes one or more bottom augers, at least one of which is a ribbon auger, and one or more top augers positioned above the one or more bottom augers.

One embodiment of such a horizontal mixer is shown with reference to FIGS. 1 to 4 and is shown generally at 100. The mixer 100 has an open top into which bulk material, such as bulk agricultural material, may be placed to be mixed. The mixing container is defined by side walls 130 and 135 that are connected at their bottom ends by a trough 160. A front wall 150 and a rear wall 120 span each end of the mixing container thereby forming the open top mixing container, also referred to as a mixing chamber.

Figure 3:
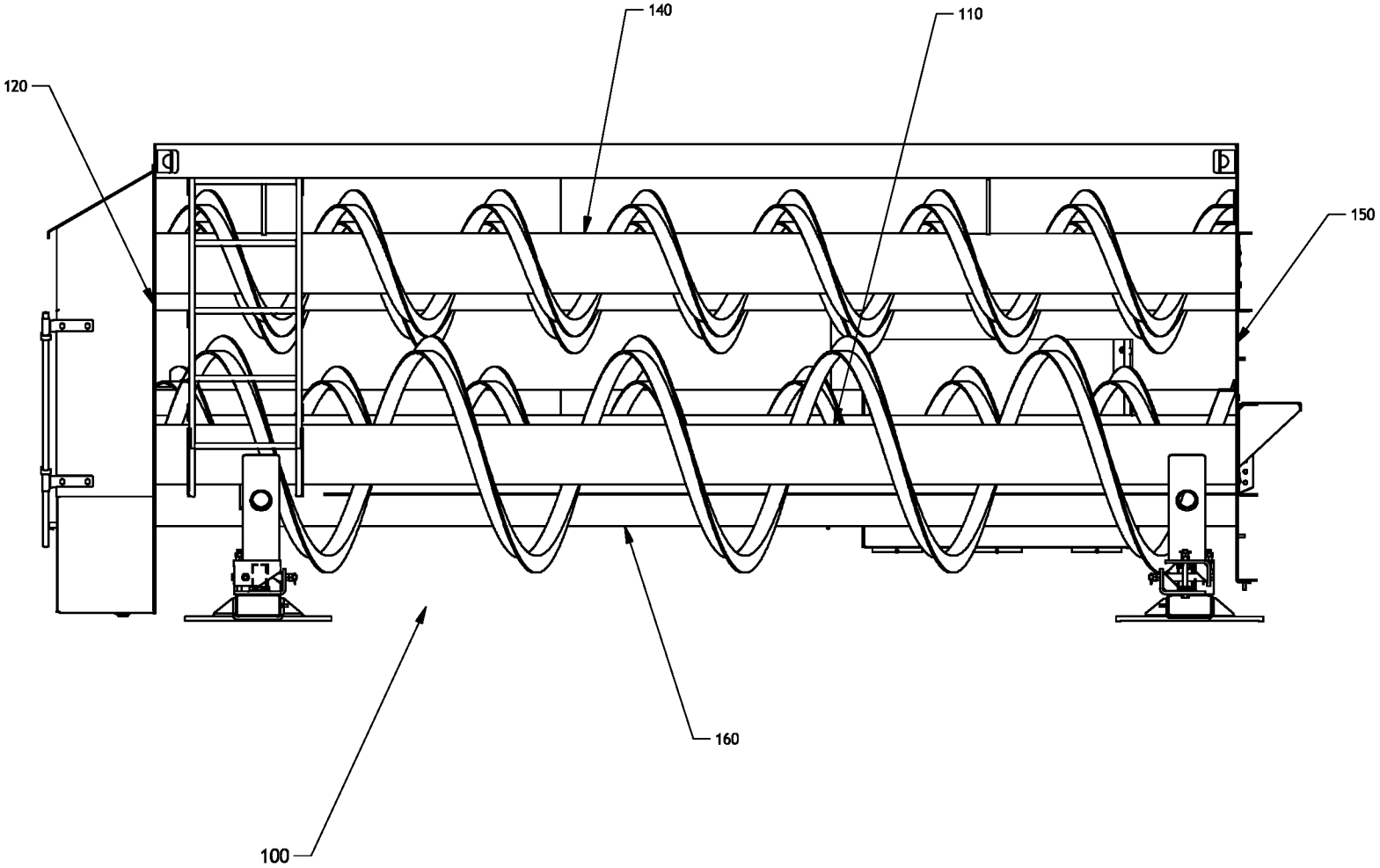
FIG. 3 is a schematic showing a side view of the horizontal mixer shown in FIG. 1.
Figure 4:
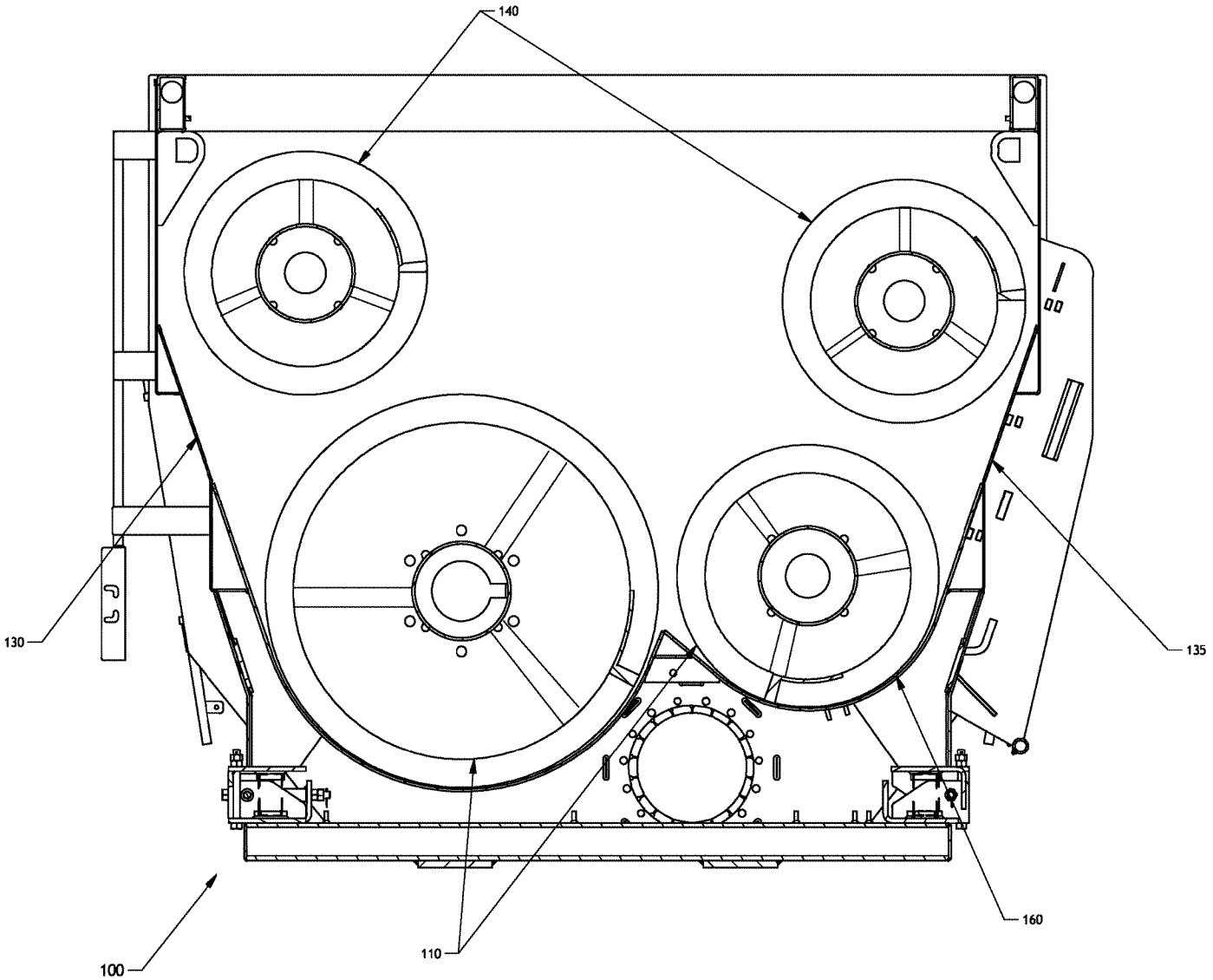
FIG. 4 is a schematic showing an end view of the horizontal mixer shown in FIG. 1.

The embodiment of the horizontal mixer 100 shown in FIGS. 1-4 is a quad auger mixer and includes two sets of stacked augers as can be more clearly seen in the side view of FIG. 3 and end view of FIG. 4. The mixer 100 includes bottom augers 110 which are longitudinally positioned in the mixing container. The trough 160 has a W-shape to accommodate the dual bottom augers 110 such that each of the bottom augers is at least somewhat encapsulated or sunk into its own trough. As can be seen in FIG. 4, the W-shaped trough 160 is comprised of two parallel troughs each adapted to accommodate its own auger and may be of different sizes based, for example, on the diameter of the auger which is to be accommodated. For example, each bottom auger may have a different diameter and may be positioned at a different height. Further, each trough of the W-shaped trough 160 may be adapted to extend upwards around the auger a certain distance or percentage. For example, FIG. 4 shows the left trough of the W-shaped trough 160 extending about 40% upwards on the larger auger of the bottom augers 110 and the right trough extending about 25% upwards on the smaller auger of the bottom augers 110. In other words, about 40% of the larger auger is captured or encapsulated by the trough and about 25% of the smaller auger is captured or encapsulated by the trough of the W-shaped trough 160. It will be appreciated that the trough or troughs may be adapted to capture or encapsulate any suitable amount of the augers to be positioned therein as desired or required.

By setting the bottom augers 110 in their respective trough, it is believed that friction is generated between bulk material in the mixing container, the bottom augers 110 and the trough 160 that aids in mixing the bulk material.

It has been surprisingly determined that it can be useful to enhance mix quality and mixing speed to further include, in optional embodiments, augers that have a dual pitch, meaning that one portion of the auger has a pitch that draws the material in one direction while another portion of the auger has a pitch that will draw the material in a different direction. For example, the bottom augers may include a dual pitch that draws material from an area towards the front and rear walls 150 and 120, towards a middle area.

Further, it has been surprisingly determined that using at least one ribbon auger one or both of the bottom augers is effective in decreasing power requirements for mixing the bulk material and can also result in reducing mix time and/or increasing mixing quality. In various tests power requirements were reduced by about 40% as compared to a conventional setup while maintaining as good as or showing improved mix quality. Further, by adopting a stacked auger setup and by using at least one ribbon auger on the bottom of the stack, it was possible to increase rotation of the augers to 27 rpm as compared to about 8 rpm in a conventional setup. This allows for decreased mix times. Mixing times as low as 2 minutes have been observed using a mixer of the current invention. The augers may be operated at any suitable speed, for example, from about 1 to about 40, from about 2 to about 30 rpm, from about 2 to about 20 rpm, or, for example at speeds greater than conventional augers, for example at speeds greater than 12 rpm. It will be appreciated that the augers may be operated at any suitable speed within the ranges mentioned and it is intended that reference to the range is also a reference to each suitable speed therein. Without wishing to be bound by theory it is believed that this may be partially due to the lower weight of the ribbon auger as compared to conventional augers that allow the auger to rotate more quickly using less power. The bulk material, such as feed, flows through the auger and greatly reduces pressure on the feed and thus reduces power requirements and/or consumption. Further, the lower weight of the ribbon auger allows more material to be placed in the mixer as the gross weight can remain the same while additional material is added.

As shown in FIGS. 1-4, the mixer 100 includes at least one top auger and in the example of FIGS. 1-4, two top augers 140 positioned longitudinally in the mixing container and above the bottom augers 110. The top augers 140 may be optionally, and independently of each other, conventional or ribbon augers. The top augers 140 are positioned above the bottom augers 110 and may be positioned proximate the side walls 130 and 135 to induce friction when rotated between the auger, the mix and the walls 130 and 135. It will be appreciated that the top augers 140 may positioned in any suitable location above the bottom augers 110 to promote mixing of the bulk material.

As with the bottom augers 110, the top augers 140, may have a dual pitch, meaning that one portion of the auger has a pitch that draws the material in one direction while another portion of the auger has a pitch that will draw the material in a different direction. For example, the pitch of the top augers 140 may be opposite that of the bottom augers 110 so that the top augers draw material from a middle area of the container towards the front and rear walls 150 and 120. By implementing a different pitch on the top augers than the bottom augers an increase in mix quality can be observed as well as an increase mix speed under certain conditions.

In one embodiment, all augers of the horizontal mixer are ribbon augers and the bottom augers have a dual pitch that moves material from the front and rear walls 150 and 120 towards a middle area of the mixer while the top augers have a dual pitch that moves material from a middle area towards the front and rear walls 150 and 120.

A door 170 may be positioned at any suitable location in either of the side walls 130 and 135 to allow exit of mixed material.

It will be appreciated that any suitable number and setup of stacked augers may be implemented in the horizontal mixer to suitably mix bulk material. For example, other illustrative and non-exhaustive setups are shown with reference to FIGS. 5-7.

Figure 5:
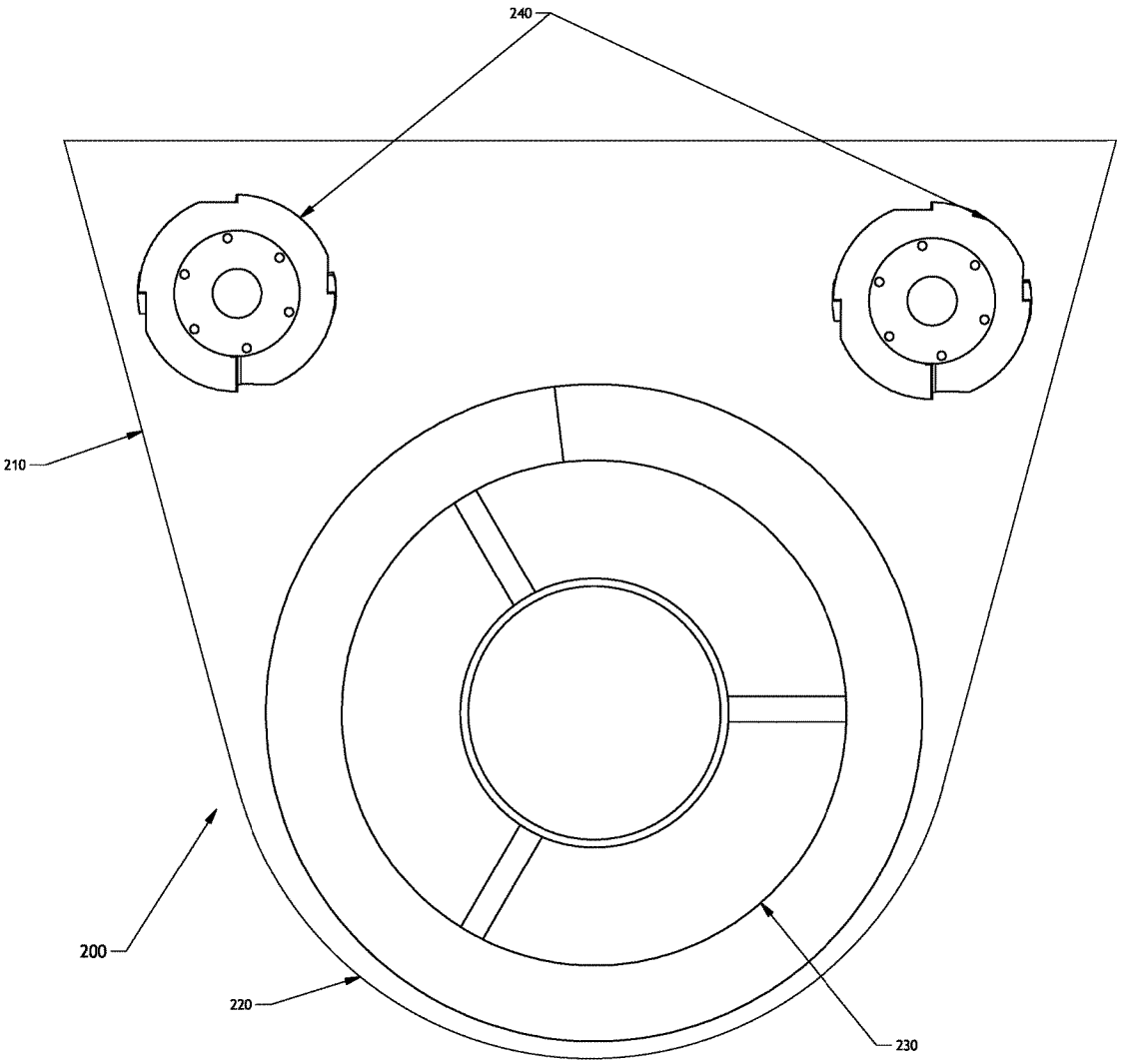
FIG. 5 is a schematic showing an end view of one embodiment of a three auger horizontal mixer with two augers stacked above a single bottom auger.

FIG. 5 shows one embodiment of a setup for a horizontal mixer 200 having stacked augers wherein a single bottom auger 230 is used and positioned in a U-shaped trough 220 that connects the side walls 210. A dual top auger 240 setup is used and the top augers 240 are positioned above and slightly off center the bottom auger 230 and positioned proximate the side walls 210. The bottom auger 230 is a ribbon auger while the top augers are conventional augers. As outlined above, the augers may optionally be dual pitched or ribbon augers to generate a circulated action of the bulk material as it is mixed.

Figure 6:
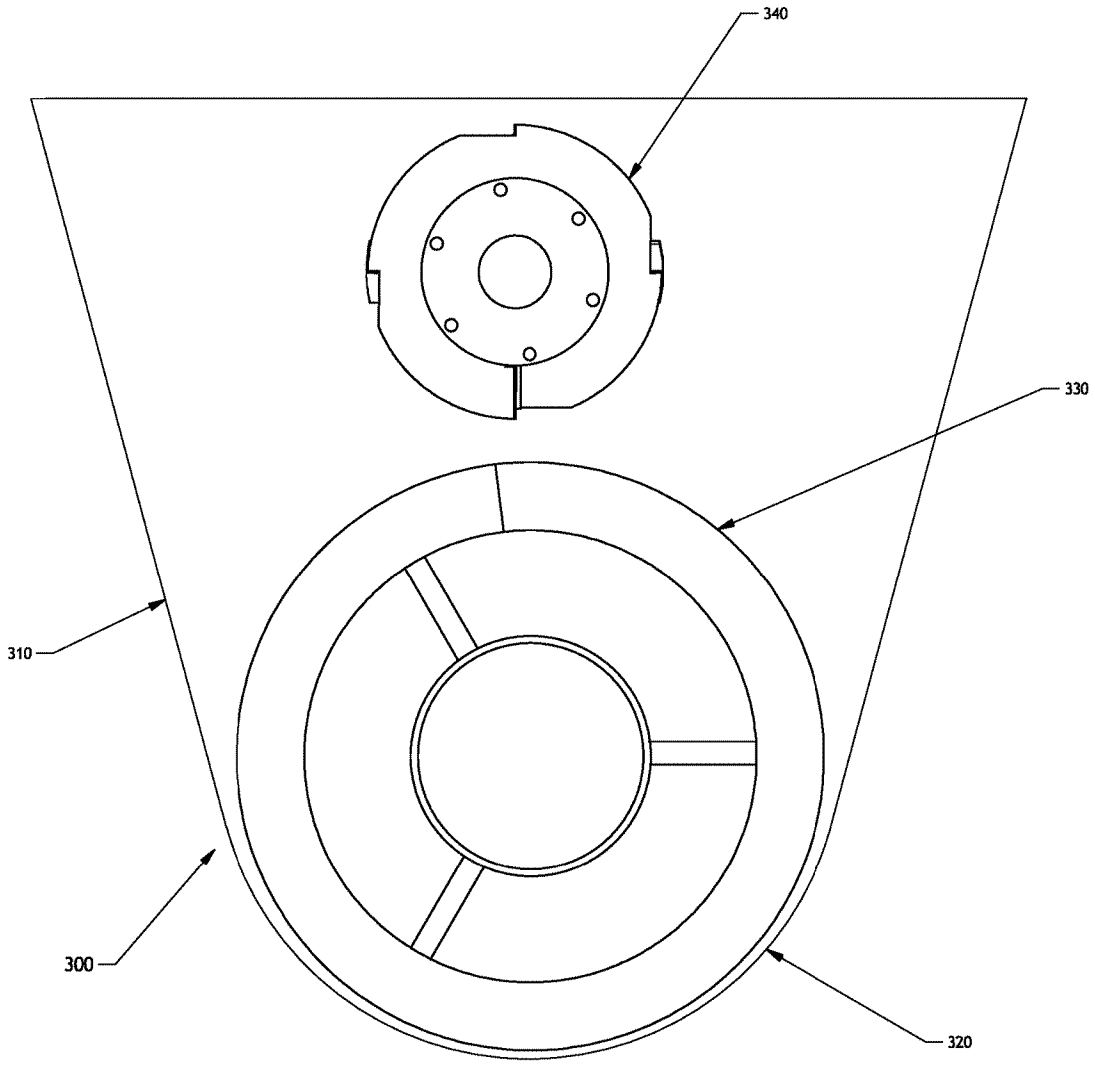
FIG. 6 is a schematic showing an end view of one embodiment of a dual auger horizontal mixer with one auger stacked above a single bottom auger.

FIG. 6 shows another embodiment of a setup for a horizontal mixer 300 having stacked augers wherein a single bottom auger 330 is used and positioned in a U-shaped trough 320 that connects the side walls 310. A single top auger 340 setup is used and the top auger 340 is positioned centered above the bottom auger 330 and positioned away from the side walls 310. The bottom auger 330 is a ribbon auger while the top auger is a conventional auger. As outlined above, the augers may optionally be dual pitched or ribbon augers to generate a circulated action of the bulk material as it is mixed.

Figure 7:
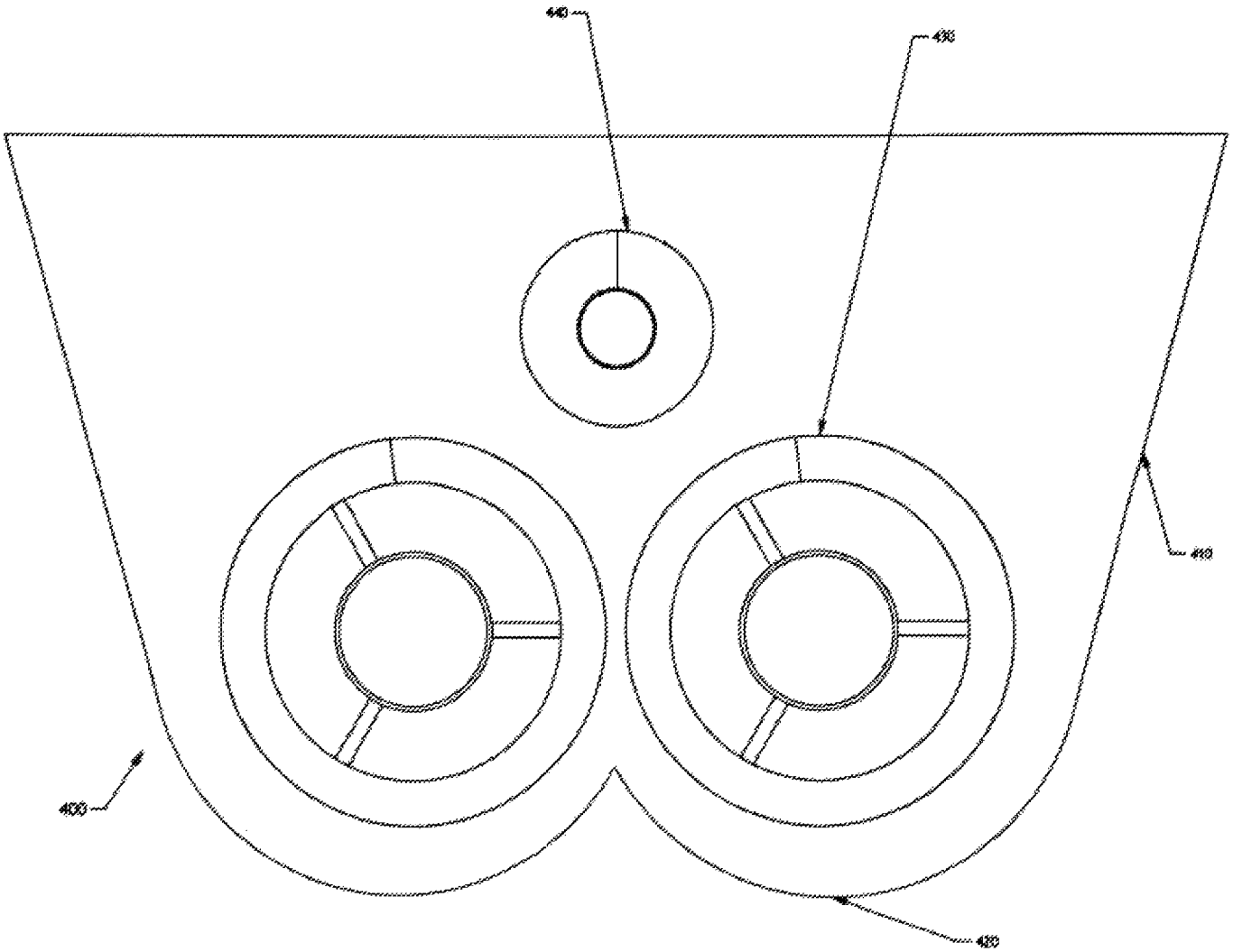
FIG. 7 is a schematic showing an end view of one embodiment of a three auger horizontal mixer with one auger stacked above two bottom augers.

FIG. 7 shows another embodiment of a setup for a horizontal mixer 400 having stacked augers wherein dual bottom augers 430 are used and each is positioned in adjacent troughs of a W-shaped trough 420 that connects the side walls 410. A single top auger 440 setup is used and the top auger 440 is positioned centered above the bottom augers 430 and positioned away from the side walls 410. The bottom augers 430 are ribbon augers while the top auger is a conventional auger. As outlined above, the augers may optionally be dual pitched or ribbon augers to generate a circulated action of the bulk material as it is mixed.

The horizontal mixers of the invention and disclosed herein may be powered using any traditional or conventional means. For example they may be powered using a take-off, diesel or gasoline engine, hydraulics, electric motor or battery, hybrid system or any suitable combination thereof.

The horizontal mixers of the invention and disclosed herein are typically stationary mixers or truck mounted but may be adapted to be towed using suitable towing vehicles.

The horizontal mixers of the invention and disclosed herein are typically loaded through the open top where bulk material to be mixed is added. The bulk material may be agricultural material such as animal feed, bedding, compost, or other suitable bulk material. The horizontal mixer is operated to mix the material and it may be emptied from the mixer by opening the door 170. It will be appreciated that the mixer may be loaded using any suitable conventional or traditional method and may be unloaded using any suitable conventional or traditional door and door mechanism and any suitable placement of the door and door mechanism.

It will be appreciated that any of the ribbon augers, especially the bottom ribbon augers, may have at least a portion of their front face lined with a different more wear resistant material such as stainless steel or a polymer to extend the operational life of the ribbon auger. Further, the thickness of the lining may be variable to include a thicker lining in higher wear areas.

One or more illustrative embodiments have been described by way of example. It will be understood to persons skilled in the art that a number of variations and modifications can be made without departing from the scope and spirit of the invention as defined herein and in the claims.

We claim:

1. An agricultural horizontal mixer for mixing bulk agricultural material, the horizontal mixer comprising: a mixing container adapted to accommodate bulk agricultural material loads greater than 2,000 pounds to be mixed, the mixing container comprising: side walls connected at their bottom edges by a trough; a front wall spanning a front side of the container; a rear wall spanning a rear side of the container; and an exit door through which mixed material can exit; one or more bottom augers situated longitudinally in the trough, wherein at least one of the one or more bottom augers is a ribbon auger; one or more top augers situated longitudinally in the mixing container substantially above the one or more bottom ribbon augers, wherein the trough has a shape to accommodate the one or more bottom ribbon augers, wherein the one or more bottom ribbon augers has a dual pitch that draws material inward from the front wall and the rear wall toward a middle area of the container, wherein the top and bottom augers are adapted to be operated at a speed above 12 rpm, wherein at least a portion of a front face of at least one of the ribbon augers includes a lining, and wherein the lining has a varied thickness and comprises an increased thickness in a higher wear region.

2. The horizontal mixer of claim 1, wherein the one or more top augers has a dual pitch that draws material outward from the middle area of the container toward the front and the rear walls.

3. The horizontal mixer of claim of 1, wherein the one or more top augers is a ribbon auger.

4. The horizontal mixer of claim 1, wherein there are at least two bottom augers and the second bottom auger is a conventional auger.

5. The horizontal mixer of claim 1, wherein there are at least two bottom augers and all bottom augers are ribbon augers.

6. The horizontal mixer of claim 1, wherein there are two bottom augers and the trough has a W-shape including two adjacent longitudinal troughs, each for accommodating one of the bottom augers.

7. The horizontal mixer of claim 1, wherein there is a single bottom auger and the trough has a U-shape for accommodating the single bottom auger.

8. The horizontal mixer of claim 1, wherein the mixer comprises two bottom augers and a single top auger situated generally centered above the two bottom augers.

9. The horizontal mixer of claim 1, wherein the mixer comprises two bottom augers and two top augers situated generally above the two bottom augers and generally proximate the side walls of the mixer.

10. The horizontal mixer of claim 9, wherein the two top augers are situated generally above and at least slightly outward the two bottom augers.

11. The horizontal mixer of claim 1, wherein the mixer comprises a single bottom ribbon auger and a single top auger positioned above the bottom ribbon auger.

12. The horizontal mixer of claim 1, wherein the mixer comprises a single bottom ribbon auger and two top augers positioned above the bottom ribbon auger and generally proximate the side walls of the mixer.

13. The horizontal mixer of claim 1, wherein the one or more top augers have a different pitch and/or diameter than at least one of the one or more bottom augers.

14. The horizontal mixer of claim 1, wherein the one or more bottom augers have the same or a different pitch and/or diameter.

15. The horizontal mixer of claim 1, wherein the one or more top augers have the same or a different pitch and/or diameter.

16. The horizontal mixer of claim 1, wherein the top and bottom augers are adapted to be operated at a speed of 12 to 40 rpm.

17. The horizontal mixer of claim 1, wherein the top and bottom augers are adapted to be operated at a speed above 12 rpm.

18. The horizontal mixer of claim 1, wherein the lining is stainless steel or a polymer.

19. The horizontal mixer of claim 1, wherein the horizontal mixer has an open top.

20. The horizontal mixer of claim 1, wherein the mixing container is adapted to mix loads from greater than 2,000 to 40,000 pounds.

* * * * *